US011574780B2

(12) United States Patent
Tsai

(10) Patent No.: US 11,574,780 B2
(45) Date of Patent: Feb. 7, 2023

(54) KEY STRUCTURE

(71) Applicant: Primax Electronics Ltd., Taipei (TW)

(72) Inventor: Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/389,101

(22) Filed: Jul. 29, 2021

(65) Prior Publication Data

US 2022/0415592 A1 Dec. 29, 2022

(30) Foreign Application Priority Data

Jun. 28, 2021 (TW) ..... 110123614

(51) Int. Cl.
*H01H 13/84* (2006.01)
*H01H 13/7065* (2006.01)
*H01H 3/12* (2006.01)

(52) U.S. Cl.
CPC ..... *H01H 13/84* (2013.01); *H01H 3/125* (2013.01); *H01H 13/7065* (2013.01)

(58) Field of Classification Search
CPC ..... H01H 2215/00; H01H 2215/03; H01H 2215/004; H01H 3/00; H01H 3/02; H01H 3/12; H01H 3/125; H01H 13/00; H01H 13/7065; H01H 13/84; H01H 2221/00; H01H 2233/00; H01H 2233/002; H01H 2233/03; H01H 2233/07; H01H 2003/12; H01H 13/14; H01H 13/50; H01H 13/52; H01H 13/70; H01H 13/7006; H01H 13/702; H01H 13/704; H01H 13/705; H01H 3/32
USPC ..... 200/344
See application file for complete search history.

(56) References Cited

U.S. PATENT DOCUMENTS 10,128,061 B2 * 11/2018 Zercoe ..... H01H 13/06

* cited by examiner

*Primary Examiner* — Anthony R Jimenez
(74) *Attorney, Agent, or Firm* — Kirton McConkie; Evan R. Witt

(57) ABSTRACT

A key structure includes a keycap, a scissors-type connecting element, a first knocking part, a resilience element and a second knocking part. The scissors-type connecting element is coupled to a bottom surface of the keycap. The scissors-type connecting element includes an inner frame and an outer frame. The first knocking part is disposed within a space surrounded by the inner frame. The resilience element is located under the first knocking part. The second knocking part is coupled to the bottom surface of the keycap and faces the first knocking part. While the keycap is pressed down, the second knocking part knocks on the first knocking part, and the first knocking part is moved downwardly. When the keycap is not pressed down, the first knocking part is moved upwardly and returned to an original position in response to an elastic force of the resilience element.

17 Claims, 10 Drawing Sheets

KEY STRUCTURE

FIELD OF THE INVENTION

The present invention relates to a key structure, and more particularly to a key structure capable of generating a click sound when the key structure is pressed down.

BACKGROUND OF THE INVENTION

Generally, the common peripheral input device of a computer system includes for example a mouse device, a keyboard device, or the like. Via the keyboard device, characters or symbols can be inputted into the computer system directly. As a consequence, most users pay much attention to the keyboard devices.

When the key structure of a mechanical keyboard is clicked, a click sound is generated. However, some existing keyboard devices (e.g., a slim keyboard of a notebook computer) cannot generate the click sound. When the consumer purchases a keyboard device, the sound performance of the keyboard device is usually an important factor that is taken into consideration.

Therefore, there is a need of providing a keyboard device capable of generating a sound like a clicked mechanical keyboard.

SUMMARY OF THE INVENTION

In accordance with an aspect of the present invention, a key structure is provided. The key structure includes a keycap, a scissors-type connecting element, a first knocking part, a resilience element and a second knocking part. The scissors-type connecting element is coupled to a bottom surface of the keycap. The scissors-type connecting element includes an inner frame and an outer frame. The outer frame is combined with the inner frame and swingable relative to the inner frame. The first knocking part is disposed within a space surrounded by the inner frame. The resilience element is located under the first knocking part. The second knocking part is coupled to the bottom surface of the keycap and faces the first knocking part. While the keycap is pressed down, the second knocking part knocks on the first knocking part, and the first knocking part is moved downwardly. When the keycap is not pressed down, the first knocking part is moved upwardly and returned to an original position in response to an elastic force of the resilience element.

In an embodiment, the first knocking part includes an upper portion and a surrounding portion connected with the upper portion. An accommodation space is defined by the upper portion and the surrounding portion collaboratively. The resilience element is disposed within the accommodation space.

In an embodiment, the accommodation space has a shape of a truncated cone.

In an embodiment, the resilience element is a spring.

In an embodiment, the second knocking part is integrally formed with the keycap, and the second knocking part is protruded from the bottom surface of the keycap.

In an embodiment, an area of a bottom surface of the second knocking part is smaller than an area of a top surface of an upper portion of the first knocking part.

In an embodiment, an overall thickness of the first knocking part is larger than or equal to a thickness of the second knocking part.

In an embodiment, the key structure further includes an extension part coupled to the bottom surface of the keycap.

Moreover, the extension part faces the first knocking part. A thickness of the second knocking part is larger than a thickness of the extension part.

In an embodiment, a vertical projection region of the second knocking part and a vertical projection region of an upper portion of the first knocking part are partially overlapped with each other.

In an embodiment, a vertical projection region of the second knocking part is within a vertical projection region of an upper portion of the first knocking part.

In an embodiment, the key structure further includes a membrane circuit board and a base plate. The membrane circuit board is located under the keycap and the scissors-type connecting element. The base plate is located under the membrane circuit board, the first knocking part and the resilience element.

In an embodiment, the membrane circuit board includes an opening through the membrane circuit board. The first knocking part and the resilience element are disposed within the opening.

In an embodiment, the base plate includes plural position-limiting structures protruded from a top surface of the base plate. The plural position-limiting structures are in contact with plural regions of the first knocking part, respectively.

In an embodiment, the first knocking part includes an upper portion and a surrounding portion connected with the upper portion. The surrounding portion includes plural lateral walls and plural contact walls. The base plate includes plural position-limiting structures protruded from a top surface of the base plate. Moreover, the plural position-limiting structures are respectively in contact with the plural contact walls.

In an embodiment, the plural contact walls are substantially in parallel with a top surface of the upper portion of the first knocking part.

In an embodiment, an included angle between each of the plural lateral walls and a top surface of the upper portion of the first knocking part is larger than or equal to 90 degrees.

In an embodiment, while the first knocking part is moved downwardly, the plural contact walls of the first knocking part are moved in a direction away from the plural position-limiting structures.

In an embodiment, the key structure further includes an elastic element disposed within the space surrounded by the inner frame and adjacent to the first knocking part. When the keycap is not pressed down, the keycap and the second knocking part are moved upwardly and returned to original positions in response to an elastic force of the elastic element.

In an embodiment, from a side viewpoint, a lateral surface of the second knocking part close to the elastic element is beyond a lateral surface of the first knocking part close to the elastic element.

From the above descriptions, the key structure of the present invention includes the first knocking part, the resilience element and the second knocking part. While the keycap is pressed down, the second knocking part is moved downwardly to knock on the first knocking part. Accordingly, a click sound is generated, and the first knocking part is correspondingly moved downwardly. When the keycap is no longer pressed down, the first knocking part is moved upwardly and returned to its original position in response to the elastic force of the resilience element. Due to this structural design, the key structure of the present invention can provide the sound like the clicked mechanical keyboard. In other words, the key structure of the present invention can meet the requirements of consumers.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

As mentioned above, some existing keyboard devices cannot generate the sound like a clicked mechanical keyboard. Therefore, there is a need of providing a keyboard device capable of generating the sound like a clicked mechanical keyboard. The present invention provides a key structure in order to overcome the drawbacks of the conventional technologies. Some embodiments of the key structure of a keyboard device will be described as follows.

Figure 1:
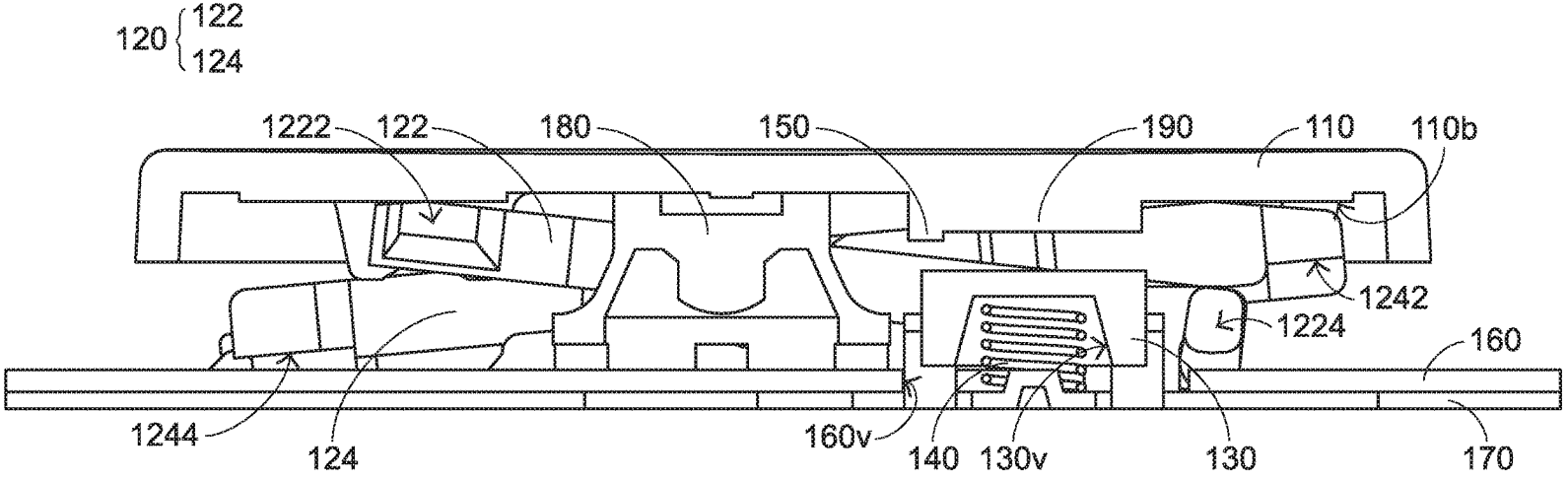
FIG. 1 is a schematic cross-sectional view illustrating a key structure according to a first embodiment of the present invention.
Figure 2:
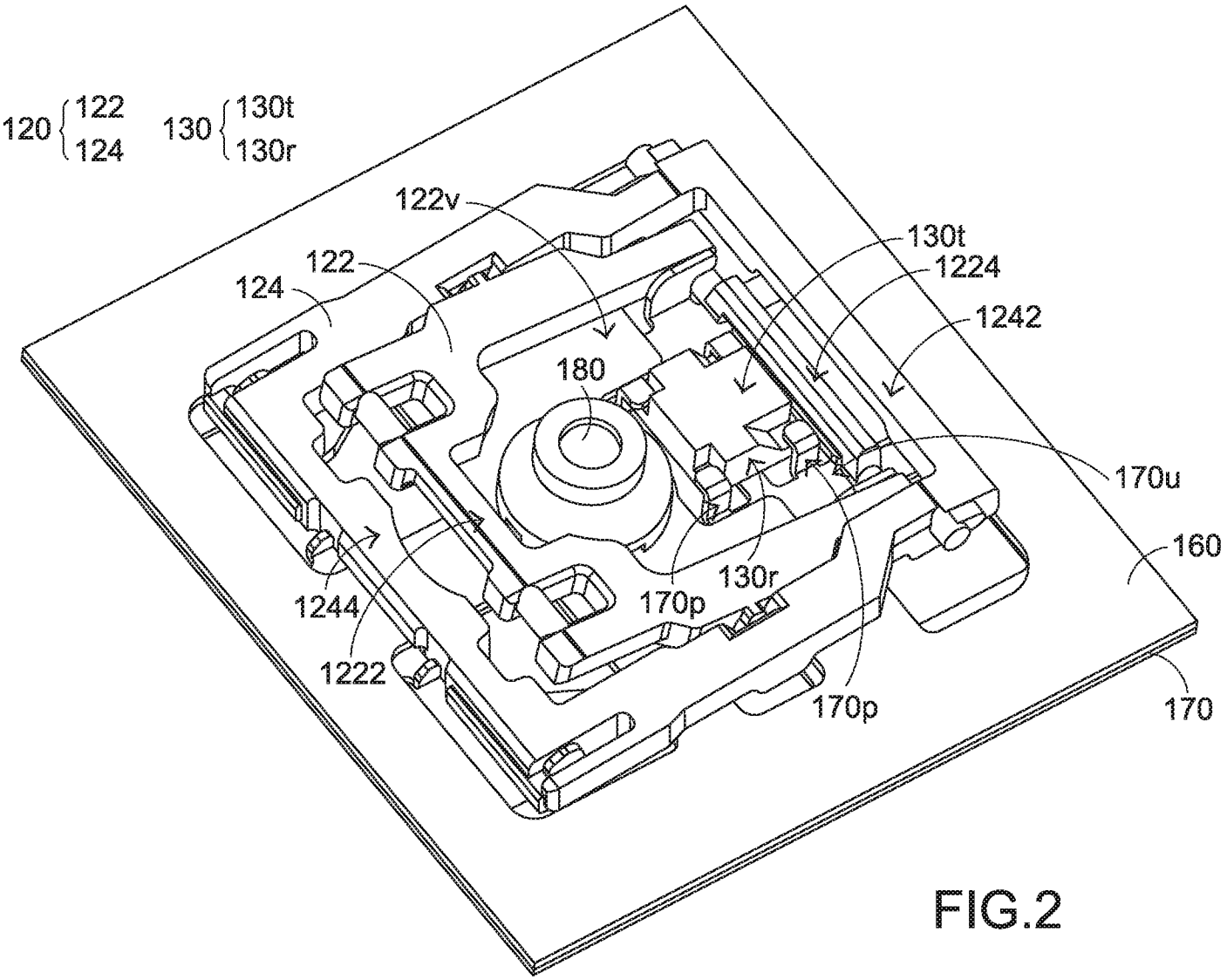
FIG. 2 is a schematic perspective view illustrating the key structure as shown in FIG. 1, in which the keycap is not shown.

The keyboard device comprises plural key structures. FIG. 1 is a schematic cross-sectional view illustrating a key structure according to a first embodiment of the present invention. FIG. 2 is a schematic perspective view illustrating the key structure as shown in FIG. 1, in which the keycap is not shown. As shown in FIGS. 1 and 2, the key structure includes a keycap 110, a scissors-type connecting element 120, a first knocking part 130, a resilience element 140 and a second knocking part 150.

As shown in FIG. 1, the scissors-type connecting element 120 is coupled to a bottom surface 110*b* of the keycap 110. As shown in FIGS. 1 and 2, the scissors-type connecting element 120 includes an inner frame 122 and an outer frame 124. The inner frame 122 has a first end 1222 and a second end 1224 opposed to each other. The first end 1222 of the inner frame 122 is connected with the keycap 110. The outer frame 124 is combined with the inner frame 122 and swingable relative to the inner frame 122. Moreover, the outer frame 124 has a first end 1242 and a second end 1244 opposed to each other. The first end 1242 of the outer frame 124 is connected with the keycap 110 and located adjacent to the second end 1224 of the inner frame 122.

As shown in FIG. 2, there is a space 122*v* surrounded by the inner frame 122, and the first knocking part 130 is disposed within the space 122*v*. As shown in FIG. 1, the resilience element 140 is located under the first knocking part 130. Moreover, the resilience element 140 is covered by the first knocking part 130. In the embodiment of FIG. 1, the resilience element 140 is a spring. It is noted that the example of the resilience element 140 is not restricted. That is, the spring can be replaced by any other appropriate resilience element.

Figure 3:
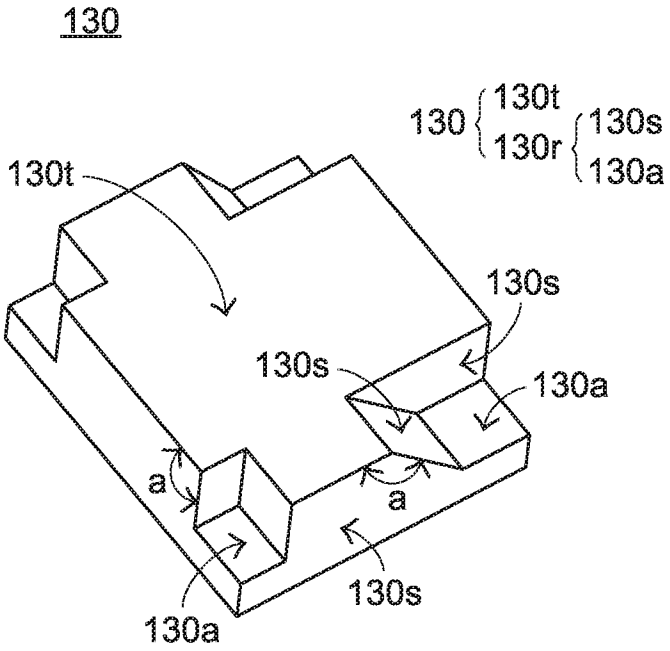
FIG. 3 is a schematic enlarged view illustrating the first knocking part of the key structure as shown in FIG. 2.

FIG. 3 is a schematic enlarged view illustrating the first knocking part of the key structure as shown in FIG. 2. As shown in FIGS. 2 and 3, the first knocking part 130 includes an upper portion 130*t* and a surrounding portion 130*r* connected with the upper portion 130*t*. As shown in FIG. 1, an accommodation space 130*v* is defined by the upper portion 130*t* and the surrounding portion 130*r* collaboratively. The resilience element 140 is disposed within the accommodation space 130*v*. In the embodiment of FIG. 1, the accommodation space 130*v* has a shape of a truncated cone. It is noted that the shape of the accommodation space 130*v* is not restricted. For example, in another embodiment, the accommodation space has a cylindrical shape, a prism shape (e.g., a triangular prism shape, a quadrangular prism shape, a pentagonal prism shape or a hexagonal prism shape), or any other appropriate shape.

In the embodiment of FIG. 3, the surrounding portion 130*r* of the first knocking part 130 includes plural lateral walls 130*s* and plural contact walls 130*a*. In some embodiments, each lateral wall 130*s* is connected with at least two contact walls 130*a*. For example, as shown in FIG. 3, each lateral wall 130*s* is connected with four contact walls 130*a*. In some embodiments, these contact walls 130*a* are substantially in parallel with a top surface of the upper portion 130*t* of the first knocking part 130. In some embodiments, the included angle between each of the lateral walls 130*s* and the top surface of the upper portion 130*t* of the first knocking part 130 is larger than or equal to 90 degrees. In an embodiment, the top surface of the upper portion 130*t* of the first knocking part 130 is cross-shaped. It is noted that the shape of the top surface of the upper portion 130*t* is not restricted. That is, the top surface of the upper portion 130*t* of the first knocking part 130 can have any other appropriate shape.

Figure 4:
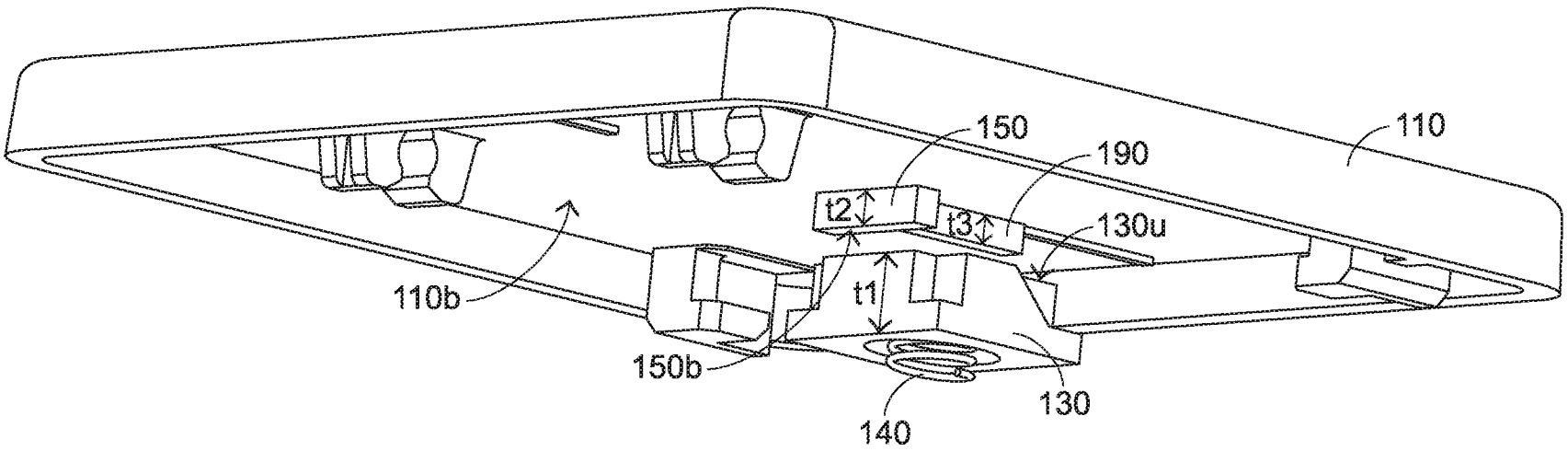
FIG. 4 is a perspective view illustrating the relationships between the keycap, the second knocking part, the first knocking part and the resilience element of the key structure as shown in FIG. 1.

FIG. 4 is a perspective view illustrating the relationships between the keycap, the second knocking part, the first knocking part and the resilience element of the key structure as shown in FIG. 1. As shown in FIGS. 1 and 4, the second knocking part 150 is coupled to the bottom surface 110*b* of the keycap 110. Moreover, the second knocking part 150 faces the first knocking part 130. In some embodiments, the second knocking part 150 is integrally formed with the keycap 110, and the second knocking part 150 is protruded from the bottom surface 110*b* of the keycap 110. In the embodiment of FIG. 4, the area of a bottom surface 150*b* of the second knocking part 150 is smaller than the area of the top surface 130*u* of the upper portion 130*t* of the first knocking part 130. In the embodiment of FIG. 4, the overall thickness t1 of the first knocking part 130 is larger than or equal to the thickness t2 of the second knocking part 150.

Please refer to FIGS. 1 and 2 again. In an embodiment, the key structure further includes a membrane circuit board 160. The membrane circuit board 160 is located under the keycap 110 and the scissors-type connecting element 120. In some embodiments, the membrane circuit board 160 includes plural film layers (not shown) and a membrane switch (not shown). The plural film layers are stacked with each other. In the embodiment of FIG. 1, the membrane circuit board 160 includes an opening 160*v*. The opening 160*v* runs through the membrane circuit board 160. The first knocking part 130 and the resilience element 140 are disposed within the opening 160*v*.

Please refer to FIGS. 1 and 2 again. In an embodiment, the key structure further includes a base plate 170. The base plate 170 is located under the membrane circuit board 160, the first knocking part 130 and the resilience element 140. The scissors-type connecting element 120 is connected between the keycap 110 and the base plate 170. The second end 1224 of the inner frame 122 and the second end 1244 of the outer frame 124 are connected with the base plate 170.

Please refer to FIG. 2 again. In an embodiment, the base plate 170 includes plural position-limiting structures 170*p*. The plural position-limiting structures 170*p* are protruded from a top surface 170*u* of the base plate 170 and respectively in contact with plural regions of the first knocking part 130. In the embodiment of FIGS. 2 and 3, the plural position-limiting structures 170*p* of the base plate 170 abut against the plural contact walls 130*a* of the first knocking part 130, respectively. Please refer to FIGS. 1, 2 and 3 again. While the first knocking part 130 is moved downwardly, the plural contact walls 130*a* of the first knocking part 130 are moved in the direction away from the position-limiting structures 170*p*.

Please refer to FIGS. 1 and 2 again. In an embodiment, the key structure further includes an elastic element 180 disposed within the space 122*v* surrounded by the inner frame 122 and located adjacent to the first knocking part 130. Please refer to FIGS. 1, 2 and 3 again. When the keycap 110 is no longer pressed down, the keycap 110 and the second knocking part 150 are moved upwardly and returned to their original positions in response to an elastic force of the elastic element 180.

The operations of the key structure will be described in more details as follows. Please refer to FIGS. 1 and 2. While the keycap 110 of the key structure is pressed down and moved downwardly relative to the base plate 170, the inner frame 122 and the outer frame 124 of the scissors-type connecting element 120 are switched from an open-scissors state to a stacked state. Moreover, as the keycap 110 is moved downwardly to compress the elastic element 180, the membrane switch of the membrane circuit board 160 is pushed and triggered by a contacting part of the elastic element 180. Consequently, the keyboard device generates a corresponding key signal. When the keycap 110 of the key structure is no longer pressed down, the keycap 110 is moved upwardly relative to the base plate 170 in response to the elastic force of the elastic element 180. Meanwhile, the inner frame 122 and the outer frame 124 are switched from the stacked state to the open-scissors state, and the keycap 110 is returned to its original position.

As mentioned above, the key structure of the present invention includes the first knocking part 130, the resilience element 140 and the second knocking part 150. Consequently, while the keycap 110 of the key structure is pressed down and moved downwardly relative to the base plate 170, the second knocking part 150 coupled to the keycap 110 is moved downwardly to knock on the first knocking part 130. Accordingly, a click sound is generated, and the first knocking part 130 is correspondingly moved downwardly. When the keycap 110 is no longer pressed down, the first knocking part 130 is moved upwardly and returned to its original position in response to the elastic force of the resilience element 140. Due to this structural design, the key structure of the present invention can provide the sound like the clicked mechanical keyboard. In other words, the key structure of the present invention can meet the requirements of consumers.

Please refer to FIGS. 1 and 4 again. In an embodiment, a knocking surface (i.e., the bottom surface 150*b*) of the second knocking part 150 has a rectangular shape, and the vertical projection region of the second knocking part 150 and the vertical projection region of the upper portion of the first knocking part 130 are partially overlapped with each other.

From the side viewpoint of FIG. 1, the lateral surface of the second knocking part 150 close to the elastic element 180 and the lateral surface of the first knocking part 130 close to the elastic element 180 are misaligned with each other. Especially, the lateral surface of the second knocking part 150 close to the elastic element 180 is beyond the lateral surface of the first knocking part 130 close to the elastic element 180. In other words, the second knocking part 150 is closer to the middle region of the elastic element 180 and the keycap 110 than the first knocking part 130. Consequently, the uniformity of the click sound is enhanced.

Please refer to FIGS. 1 and 4 again. In an embodiment, the key structure further includes an extension part 190 coupled to the bottom surface 110*b* of the keycap 110. The extension part 190 faces the first knocking part 130. The thickness t2 of the second knocking part 150 is larger than the thickness t3 of the extension part 190. In an embodiment, the extension part 190 is integrally formed with the keycap 110, and the extension part 190 is protruded from the bottom surface 110*b* of the keycap 110. In an embodiment, the extension part 190 is laterally adjacent to the second knocking part 150. Preferably but not exclusively, the second knocking part 150 and the extension part 190 from the top viewpoint are connected with each other to be collaboratively formed as a T-shaped structure. In an embodiment, the vertical projection region of the extension part 190 is within the vertical projection region of the upper portion of the first knocking part 130. From the side viewpoint of FIG. 1, the lateral surface of the extension part 190 away from the elastic element 180 and the lateral surface of the first knocking part 130 away from the elastic element 180 are misaligned with each other. Especially, the lateral surface of the first knocking part 130 away from the elastic element 180 is beyond the lateral surface of the extension part 190 away from the elastic element 180. Please refer to the embodiment of FIG. 1. When the second knocking part 150 knocks on the left side of the first knocking part 130, the right side of the first knocking part 130 is uplifted to collide with the extension part 190. Consequently, the volume of the click sound is increased.

In the practical applications, the installation position, the shape and the size of the second knocking part 150 may be properly varied to adjust the uniformity and the loudness of the click sound. The loudness denotes the intensity of the sound. Hereinafter, some various embodiments will be described as follows. It is noted that the concepts of the present invention are not limited to these embodiments.

Figure 5:
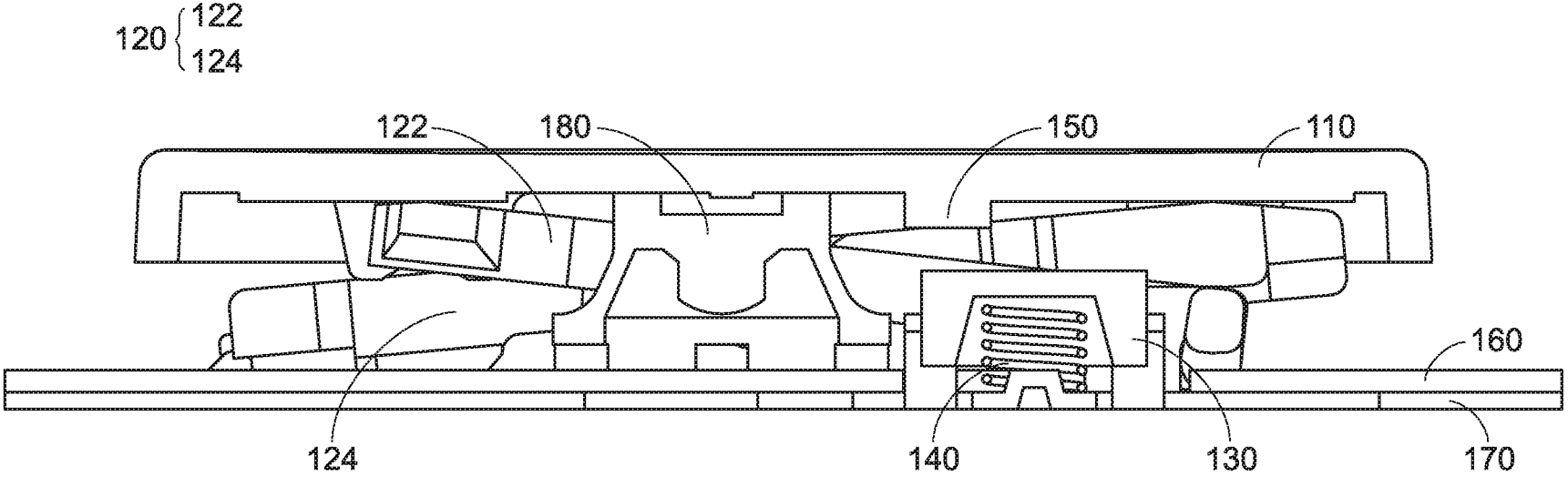
FIG. 5 is a schematic cross-sectional view illustrating a key structure according to a second embodiment of the present invention.
Figure 6:
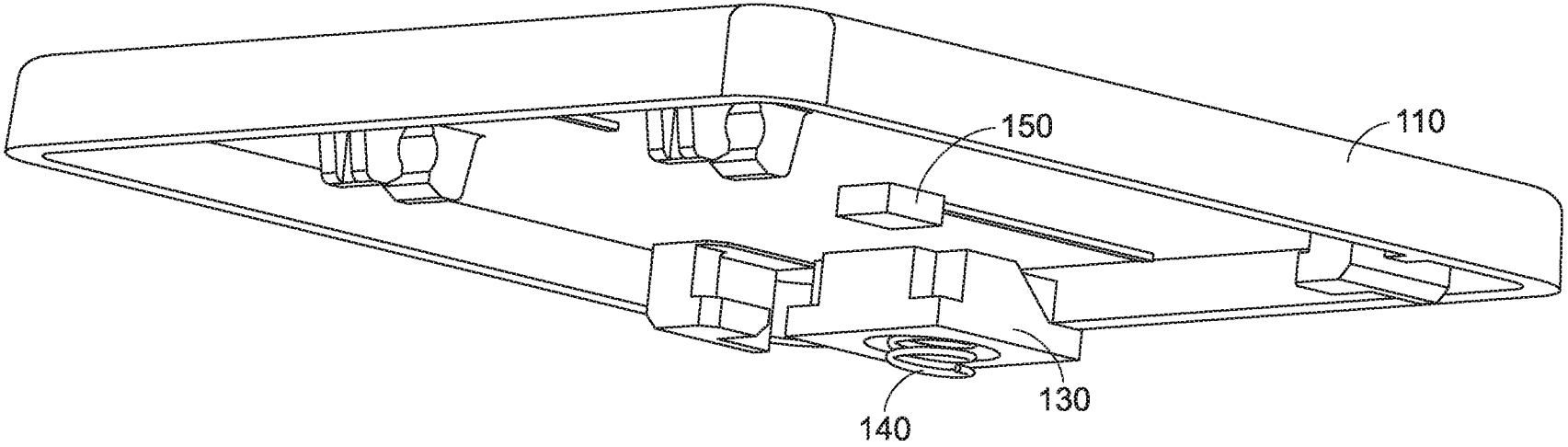
FIG. 6 is a perspective view illustrating the relationships between the keycap, the second knocking part, the first knocking part and the resilience element of the key structure as shown in FIG. 5.

FIG. 5 is a schematic cross-sectional view illustrating a key structure according to a second embodiment of the present invention. FIG. 6 is a perspective view illustrating the relationships between the keycap, the second knocking part, the first knocking part and the resilience element of the key structure as shown in FIG. 5. In comparison with the embodiment of FIGS. 1 and 4, the knocking surface (i.e., the bottom surface) of the second knocking part 150 of the key structure in the embodiment of FIGS. 5 and 6 has a square shape.

Figure 7:
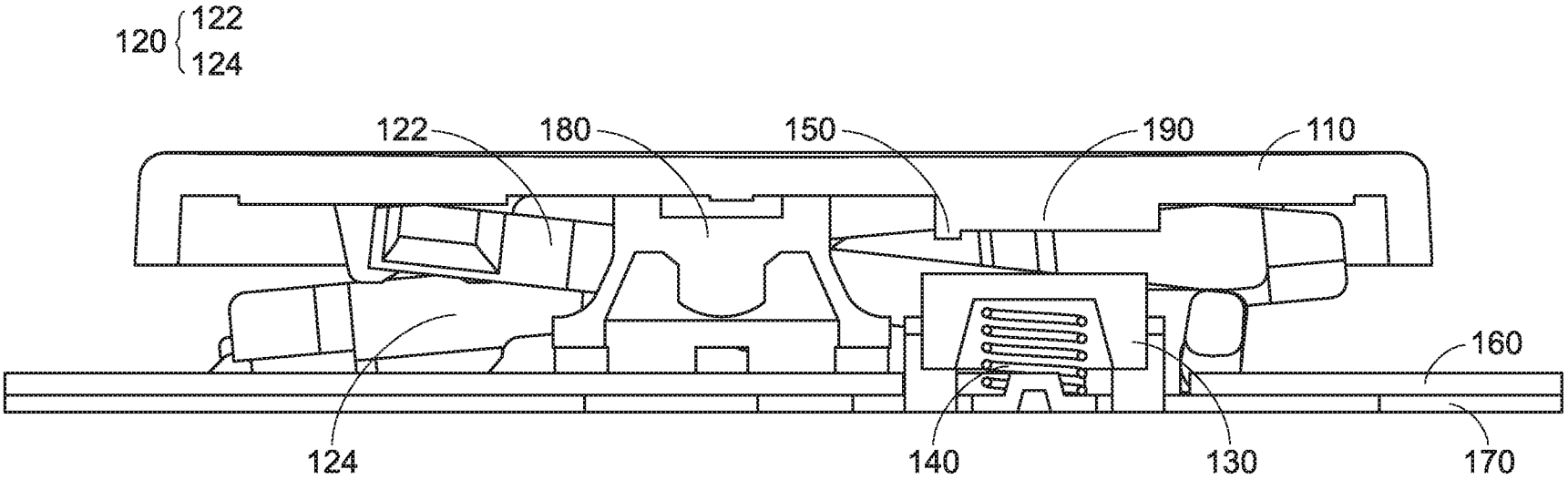
FIG. 7 is a schematic cross-sectional view illustrating a key structure according to a third embodiment of the present invention.
Figure 8:
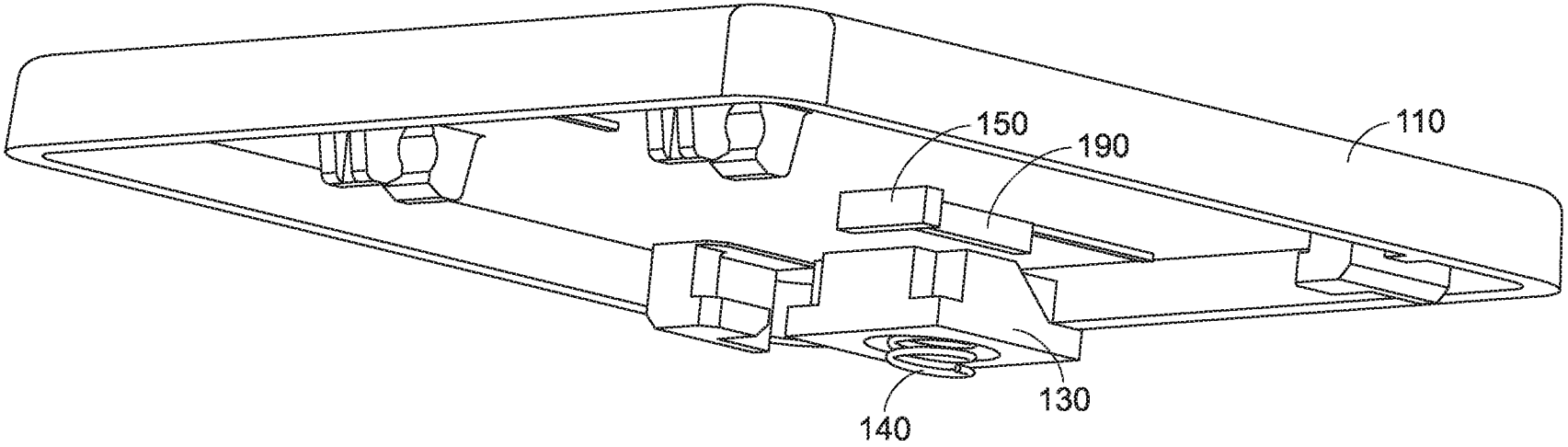
FIG. 8 is a perspective view illustrating the relationships between the keycap, the second knocking part, the first knocking part and the resilience element of the key structure as shown in FIG. 7.

FIG. 7 is a schematic cross-sectional view illustrating a key structure according to a third embodiment of the present invention. FIG. 8 is a perspective view illustrating the relationships between the keycap, the second knocking part, the first knocking part and the resilience element of the key structure as shown in FIG. 7. The locations of the second knocking part 150 and the extension part 190 in the embodiment of FIGS. 7 and 8 are different from those of FIGS. 1 and 4. Especially, in the embodiment of FIGS. 7 and 8, the vertical projection region of the second knocking part 150 is within the vertical projection region of the upper portion 130*t* of the first knocking part 130. From the side viewpoint of FIG. 7, the lateral surface of the first knocking part 130 close to the elastic element 180 is beyond the lateral surface of the second knocking part 150 close to the elastic element 180. In the embodiment of FIGS. 7 and 8, the vertical projection region of the extension part 190 and the vertical projection region of the upper portion of the first knocking part 130 are partially overlapped with each other. From the side viewpoint of FIG. 7, the lateral surface of the extension part 190 away from the elastic element 180 is beyond the lateral surface of the first knocking part 130 away from the elastic element 180.

Figure 9:
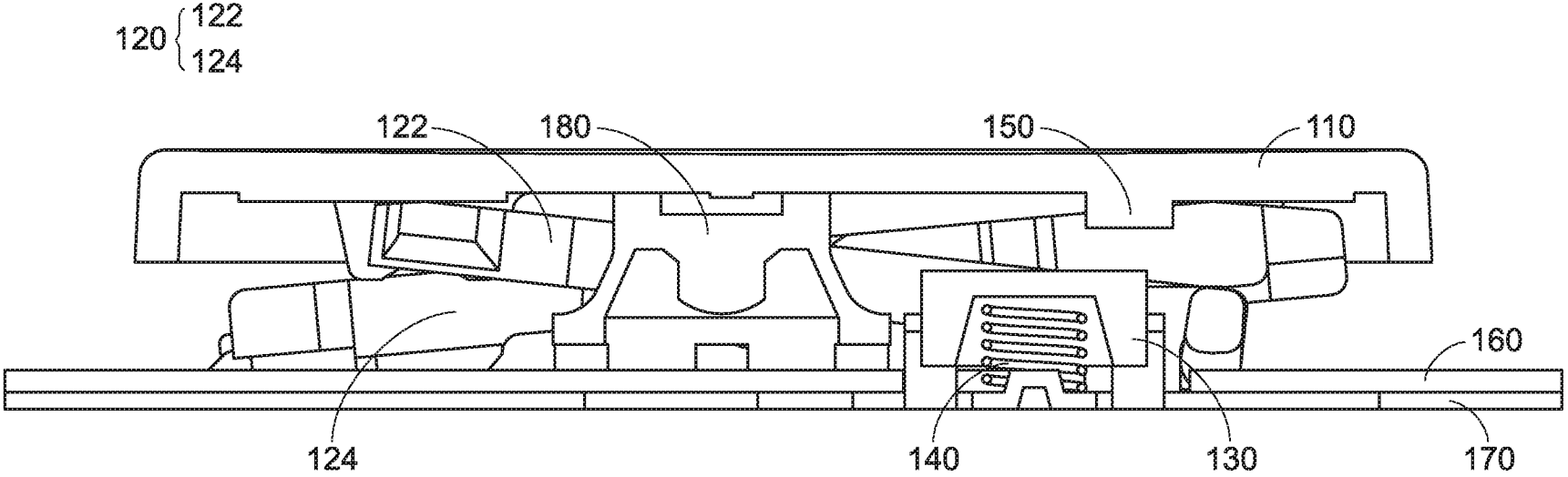
FIG. 9 is a schematic cross-sectional view illustrating a key structure according to a fourth embodiment of the present invention.
Figure 10:
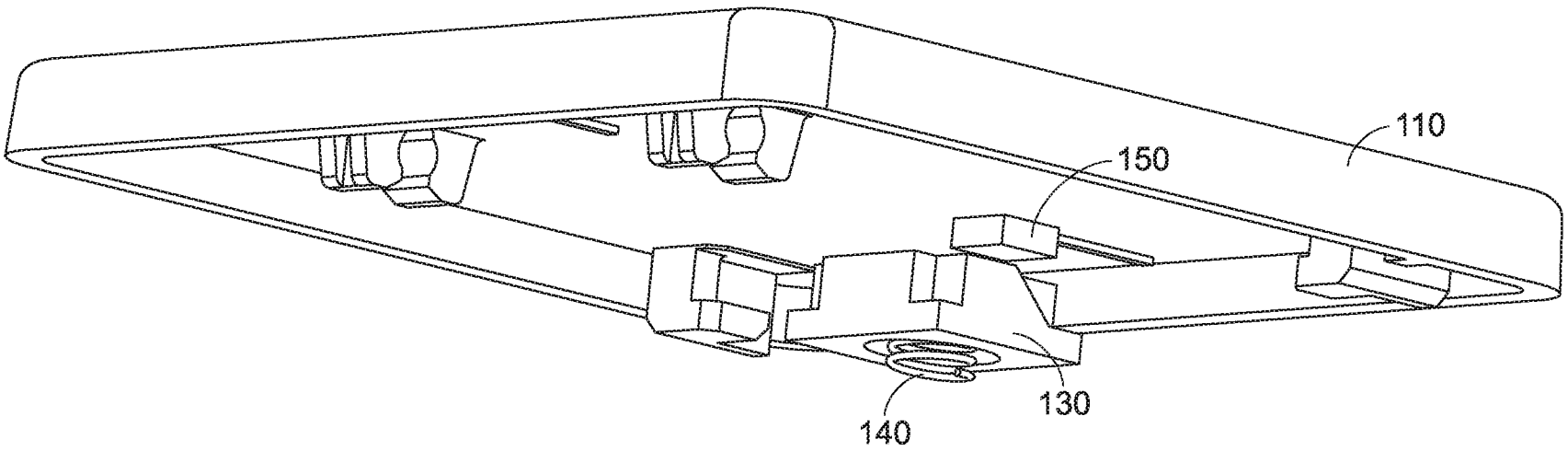
FIG. 10 is a perspective view illustrating the relationships between the keycap, the second knocking part, the first knocking part and the resilience element of the key structure as shown in FIG. 9.

FIG. 9 is a schematic cross-sectional view illustrating a key structure according to a fourth embodiment of the present invention. FIG. 10 is a perspective view illustrating the relationships between the keycap, the second knocking part, the first knocking part and the resilience element of the key structure as shown in FIG. 9. The locations of the second knocking part 150 in the embodiment of FIGS. 9 and 10 are different from those of FIGS. 5 and 6. The distance between the second knocking part 150 and the elastic element 180 in the embodiment of FIGS. 9 and 10 is longer than that in the embodiment of FIGS. 5 and 6.

From the above descriptions, the present invention provides the key structure. When the second knocking part knocks on the first knocking part, the click sound is generated. The sound generated by the key structure of the present invention is similar to the sound when the mechanical keyboard is clicked. Moreover, the key structure of the present invention also provides the feedback feel of the elastic element.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap;

a scissors-type connecting element coupled to a bottom surface of the keycap, wherein the scissors-type connecting element comprises an inner frame and an outer frame, wherein the outer frame is combined with the inner frame and swingable relative to the inner frame;

a first knocking part disposed within a space surrounded by the inner frame;

a resilience element located under the first knocking part;

a membrane circuit board located under the keycap and the scissors-type connecting element;

a base plate located under the membrane circuit board, the first knocking part and the resilience element, wherein the base plate comprises plural position-limiting structures protruded from a top surface of the base plate, wherein the plural position-limiting structures are in contact with plural regions of the first knocking part, respectively; and a second knocking part coupled to the bottom surface of the keycap and facing the first knocking part, wherein while the keycap is pressed down, the second knocking part knocks on the first knocking part, and the first knocking part is moved downwardly, wherein when the keycap is not pressed down, the first knocking part is moved upwardly and returned to an original position in response to an elastic force of the resilience element.

2. The key structure according to claim 1, wherein the first knocking part comprises an upper portion and a surrounding portion connected with the upper portion, wherein an accommodation space is defined by the upper portion and the surrounding portion collaboratively, and the resilience element is disposed within the accommodation space.

3. The key structure according to claim 2, wherein the accommodation space has a shape of a truncated cone.

4. The key structure according to claim 1, wherein the resilience element is a spring.

5. The key structure according to claim 1, wherein the second knocking part is integrally formed with the keycap, and the second knocking part is protruded from the bottom surface of the keycap.

6. The key structure according to claim 1, wherein an area of a bottom surface of the second knocking part is smaller than an area of a top surface of an upper portion of the first knocking part.

7. The key structure according to claim 1, wherein an overall thickness of the first knocking part is larger than or equal to a thickness of the second knocking part.

8. The key structure according to claim 1, further comprising an extension part coupled to the bottom surface of the keycap and facing the first knocking part, wherein a thickness of the second knocking part is larger than a thickness of the extension part.

9. The key structure according to claim 1, wherein a vertical projection region of the second knocking part and a vertical projection region of an upper portion of the first knocking part are partially overlapped with each other.

10. The key structure according to claim 1, wherein a vertical projection region of the second knocking part is within a vertical projection region of an upper portion of the first knocking part.

11. The key structure according to claim 1, wherein the membrane circuit board comprises an opening through the membrane circuit board, wherein the first knocking part and the resilience element are disposed within the opening.

12. The key structure according to claim 1, wherein the first knocking part comprises an upper portion and a surrounding portion connected with the upper portion, wherein the surrounding portion comprises plural lateral walls and plural contact walls, and the base plate comprises plural position-limiting structures protruded from a top surface of the base plate, and the plural position-limiting structures are respectively in contact with the plural contact walls.

13. The key structure according to claim 12, wherein the plural contact walls are substantially in parallel with a top surface of the upper portion of the first knocking part.

14. The key structure according to claim 12, wherein an included angle between each of the plural lateral walls and a top surface of the upper portion of the first knocking part is larger than or equal to 90 degrees.

15. The key structure according to claim 12, wherein while the first knocking par is moved downwardly, the plural contact walls of the first knocking part are moved in a direction away from the plural position-limiting structures.

16. The key structure according to claim 1, further comprising an elastic element disposed within the space surrounded by the inner frame and adjacent to the first knocking part, wherein when the keycap is not pressed down, the keycap and the second knocking part are moved upwardly and returned to original positions in response to an elastic force of the elastic element.

17. The key structure according to claim 16, wherein from a side viewpoint, a lateral surface of the second knocking part close to the elastic element is beyond a lateral surface of the first knocking part close to the elastic element.

* * * * *